US006533604B2

(12) United States Patent
Kobayashi et al.

(10) Patent No.: US 6,533,604 B2
(45) **Date of Patent: *Mar. 18, 2003**

(54) CONNECTOR TERMINALS FOR A JUNCTION CONNECTOR USED IN WIRE HARNESSES

(75) Inventors: Nobuchika Kobayashi, Mie (JP); Takeharu Ito, Mie (JP); Shigekazu Wakata, Mie (JP); Kuniharu Kusumoto, Mie (JP)

(73) Assignee: Sumitomo Wiring Systems, Ltd., Yokkaichi (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/626,451

(22) Filed: Jul. 26, 2000

(65) Prior Publication Data

US 2002/0037666 A1 Mar. 28, 2002

(30) Foreign Application Priority Data

Jul. 27, 1999 (JP) ..... 11-212838

(51) Int. Cl.[7] ..... H01R 11/20
(52) U.S. Cl. ..... 439/404; 439/651
(58) Field of Search ..... 439/651, 404, 439/949, 397

(56) References Cited

U.S. PATENT DOCUMENTS 3,745,515 A * 7/1973 Michaels ..... 439/651
4,099,822 A 7/1978 Carlisle et al.
4,127,312 A 11/1978 Fleishhacker et al.
4,533,200 A * 8/1985 Wilson ..... 439/651
5,147,218 A * 9/1992 Matthews et al. ..... 439/404
5,281,163 A 1/1994 Knox et al.
5,683,268 A 11/1997 Drach et al.
5,697,806 A * 12/1997 Whiteman, Jr. et al. .... 439/651
5,817,976 A 10/1998 Yanase et al.
5,975,937 A * 11/1999 Boischio ..... 439/404

FOREIGN PATENT DOCUMENTS

EP 0571156 11/1993

* cited by examiner

*Primary Examiner*—Gary F. Paumen
*Assistant Examiner*—Felix D Figueroa
(74) *Attorney, Agent, or Firm*—Greenblum & Bernstein, P.L.C.

(57) ABSTRACT

Connector terminals are provided to enable connection of electrical cables and connector terminals automatically to prevent the connector terminals from being inserted into sub-harnesses in later stages, and to make circuit modification easier. The connector terminals include respectively a male terminal portion at one end and a female terminal portion at the other end. The respective connector terminals further include a cable-fit portion. The connector terminals are contained in a junction case with top and bottom openings. Electrical cables are then wired in the junction case and fitted into the connector terminals. When several such junction cases are superposed, the male terminal portions fit into the female terminal portions through the openings, and the electrical cables separately wired in different junction cases are connected to one another.

16 Claims, 10 Drawing Sheets

CONNECTOR TERMINALS FOR A JUNCTION CONNECTOR USED IN WIRE HARNESSES

BACKGROUND OF THE INVENTION

1. Field of the Invention

The present invention relates to connector terminals, junction connectors containing such connector terminals, and wire harnesses equipped with such junction connectors. The connector terminals, junction connectors and wire harnesses of the present invention find applications e.g. in the automobile industry, where connection circuits must be branched in many different configurations.

2. Description of Background Information

FIG. 1 shows how an automobile wire harness W/H is assembled from a plurality of sub-harnesses. Sub-harnesses 1, 2, 3, etc. are first prepared by preliminarily binding electrical cables (primary bundling or binding step). The preliminarily bound sub-harnesses 1, 2, 3, etc. are then wired on a wire harness diagram sheet, while being held by a wiring tool. The sub-harnesses are then taped, or bound by an equivalent means, to obtain an assembled wire harness (final bundling or binding step).

When preparing sub-harnesses from electrical cables (primary bundling step), end portions of the constituent electrical cables w are inserted into connectors 4. When the electrical cables are to be connected to the connectors of another sub-harness, of a junction connector or of any other apparatus, an end portion of those electrical cables is provided with a terminal 5. In the primary bundling step where the sub-harnesses 1, 2 and 3 are preliminarily bound, these terminals 5 are not yet inserted into the corresponding connectors and are thus exposed; they are then referred to as "hanging" terminals. Accordingly, these terminals 5 are prone to deformation or damage. Moreover, when assembling the sub-harnesses (final bundling step), the "hanging" terminals must be inserted a posteriori into other sub-harnesses or a junction connector. Further, when the sub-harness electrical cables are to be connected to each other, a splicing process may become necessary. These processes therefore add up to a supplementary step.

FIG. 2 shows a commonly-used junction connector 6. The junction connector 6 has a junction case 7 which contains junction bus bars 8. In such a structure, after the sub-harnesses are assembled together, the electrical cables w to be joined are inserted into a counterpart connector 9. The counterpart connector 9 is then fitted with the junction connector 6, so that circuit connections can be established through the junction bus bars 8.

In the above junction connector 6, the "hanging" terminals 5 of the sub-harnesses are inserted into the counterpart connector 9, which is in turn fitted with the junction connector 6. This construction has the disadvantage of increasing the number of parts and process steps, thereby rendering automation more difficult, and leaving the "hanging" terminals prone to deformation up to the final bundling step. In addition, when an automobile type or automobile grade is changed, the corresponding circuits cannot be modified very easily.

SUMMARY OF THE INVENTION

The present invention intends to eliminate these shortcomings. The invention obviates later-stage insertion of the terminals and the splice connection between electrical cables, reduces the number of connectors, parts and assembling steps, and makes it possible to easily modify the circuits depending on automobile type or automobile grade.

To this end, the present invention first provides a connector terminal suitably used in a junction connector.

There is thus provided a connector terminal formed of an electrically conductive metallic material. The connector terminal includes a strip unit having a first end portion, a second end portion and a longitudinal center axis. The connector terminal further includes a cable-fit portion with a cable-fit element made by bending a part of the strip unit. The strip unit includes a male terminal portion located at the first end portion and a female terminal portion located at the second end portion. The male and female terminal portions are positioned on the longitudinal center axis, and the cable-fit element is placed apart from the male terminal portion and the female terminal portion.

Preferably, the female terminal portion includes a pair of looped ribbons made by looping side wing portions of the strip unit towards the longitudinal center axis, the looped ribbons being configured to elastically hold the male terminal portion.

Alternatively, the female terminal portion may include a notch formed along the longitudinal center axis and configured to receive the male terminal portion.

Likewise, the connector terminal may be formed of an electrically conductive metallic material, the connector terminal including a strip unit having a first end portion, a second end portion and a longitudinal center axis. The strip unit may include a male terminal portion located at the first end portion and a female terminal portion located at the second end portion. One of the male or female terminal portions may then include a notch formed along the longitudinal center axis and configured to receive an electrical cable.

The present invention also concerns a junction connector including at least a first junction case and a second junction case superposed thereon, each of the first and second junction cases having a top opening and a bottom opening, and containing electrical cables connected to the connector terminals formed of an electrically conductive metallic material.

As mentioned above, each of the connector terminals includes a strip unit having a first end portion, a second end portion and a longitudinal center axis, the connector terminal further includes a cable-fit portion with a cable-fit element made by bending a part of the strip unit. The strip unit includes a male terminal portion located at the first end portion and a female terminal portion located at the second end portion, the male and female terminal portions being positioned on the longitudinal center axis. The cable-fit elements are placed apart from the male terminal portion and the female terminal portion.

The first junction case is then superposed on the second junction case such that the male terminal portions contained in the first junction case fit into the female terminal portions contained in the second junction case and are connected thereto through the top and bottom openings.

In the above case, the female terminal portion may include a pair of looped ribbons made by looping side wing portions of the strip unit towards the longitudinal center axis, the looped ribbons being configured to elastically hold the male terminal portion.

Alternatively, the female terminal portion may include a notch formed along the longitudinal center axis and configured to receive the male terminal portion.

The present invention also concerns a junction connector including at least a first junction case and a second junction case superposed thereon, each of the first and second junction cases having a top opening and a bottom opening, and containing electrical cables connected to the connector terminals formed of an electrically conductive metallic material.

The connector terminal may include a strip unit having a first end portion, a second end portion and a longitudinal center axis, the strip unit including a male terminal portion located at the first end portion and a female terminal portion located at the second end portion. One of the male or female terminal portions includes a notch formed along the longitudinal center axis and configured to receive an electrical cable.

The first junction case is then superposed on the second junction case such that the male terminal portions contained in the first junction case fit into the female terminal portions contained in the second junction case and is connected thereto through the top and bottom openings.

In the above junction connector, the first and second junction cases may include arrays of connector terminals aligned at a given pitch, each array including a plurality of connector terminals which are fitted with a corresponding electrical cable wired along the array.

When connecting sub-harness electrical cables in each junction case, the present invention provides a method of wiring electrical cables in the junction connector, in which the junction connector and the connector terminals used are as described above.

The method of the present invention includes providing a preliminarily bundled sub-harness including electrical cables, looping the electrical cables, thereby forming two strands and a curved portion, fitting the two strands into cable-fitting portions of any arrays of connector terminals; and cutting off the curved portion so as to have two electrical cables connected.

The present invention also relates to a wire harness including a junction connector including at least a first junction case and a second junction case superposed thereon, each of the first and second junction cases having a top opening and a bottom opening, and containing electrical cables connected to the connector terminals formed of an electrically conductive metallic material.

As already mentioned, each of the connector terminals includes a strip unit having a first end portion, a second end portion and a longitudinal center axis, the connector terminal further including a cable-fit portion with a cable-fit element made by bending a part of the strip unit. The strip unit includes a male terminal portion located at the first end portion and a female terminal portion located at the second end portion. The male and female terminal portions are positioned on the longitudinal center axis, and the cable-fit element are placed apart from the male terminal portion and the female terminal portion.

As also already mentioned, the first junction case is then superposed on the second junction case such that the male terminal portions contained in the first junction case fit into the female terminal portions contained in the second junction case and is connected thereto through the top and bottom openings.

The inventive wire harness includes different sub-harnesses connected to one another through the connector terminals, any one of the sub-harnesses including a group of electrical cables connected to the connector terminals contained in the junction cases. Each sub-harness is connected to one of the junction cases, and the sub-harnesses are assembled by superposing the junction cases.

In the above wire harness, the first and second junction cases may include arrays of connector terminals aligned at a given pitch, each array including a plurality of connector terminals which are fitted with a corresponding electrical cable wired along the array.

In the above structure, an electrical cable can be electrically connected by merely press-fitting into one connector terminal. The connecting process can thus be automated easily. Further, the female terminal portion and the male terminal portion are formed either upwardly or downwardly, respectively, so that the entirety of the connector terminals and the electrical cables connected thereto can be connected to another entirety of connector terminals by merely superposing them. Furthermore, the female terminal portion and the male terminal portion are placed apart from the cable-fit portion, so that wiring of the electrical cables is easy and fitting of the latter with the cable-fit portion may be automated.

Preferably, the cable-fit notch is formed by notching a flat-shaped male terminal portion along the longitudinal center axis.

The structure of the connector terminal is thus simple. It nonetheless includes a cable-fit portion, and a male and a female terminal portion directed either upwardly or downwardly, respectively. The entirety of the connector terminals and the electrical cables connected thereto can thus be connected to another entirety of connector terminals by merely superposing them, as in the case of the first embodiment of the present invention.

As mentioned above, the connector terminals are aligned in each junction connector case, and several such cases are superposed. In this way, the connector terminals of a first and a second junction case are electrically connected by fitting the male terminal portion of the first junction case into the female terminal portions of the second junction case. In this configuration, electrical cable connections can be achieved by press-fitting the latter with chosen connector terminals. Any modifications in the circuitry, e.g. due to a change of automobile type or automobile grade, can thus be effected very easily.

As mentioned above, the electrical cables to be connected to different sub-harnesses are preliminarily connected to the connector terminals contained in respectively corresponding junction cases. When such junction cases are superposed, the male terminal portions of the connector terminals in a junction case fit into the female terminal portions of the corresponding junction case. The electrical cables of a sub-harness are thus connected to those of another sub-harness. Accordingly, subsequent insertion of terminals or a splicing process are no longer necessary. In addition, the sub-harnesses contain no "hanging" terminals, and can take the final configuration. The final bundling process can thus be simplified.

BRIEF DESCRIPTION OF THE DRAWINGS

The above and the other objects, features and advantages of the present invention will be made apparent from the following description of the preferred embodiments, given as non-limiting examples, with reference to the accompanying drawings, in which.

DETAILED DESCRIPTION OF THE PREFERRED EMBODIMENTS

Figure 1:
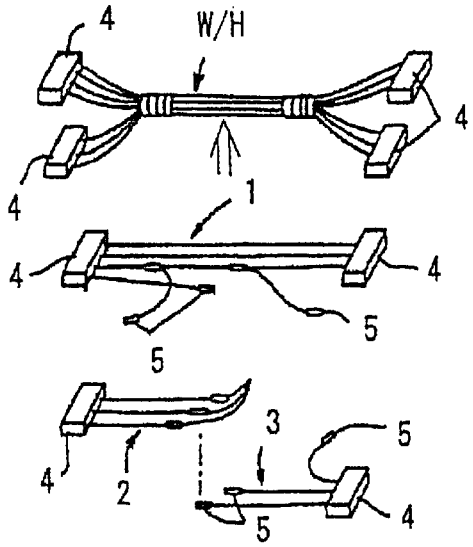
FIG.1 PRIOR ART
FIG. 1 shows sub-harnesses that compose a harness known in the prior art.
Figure 2:
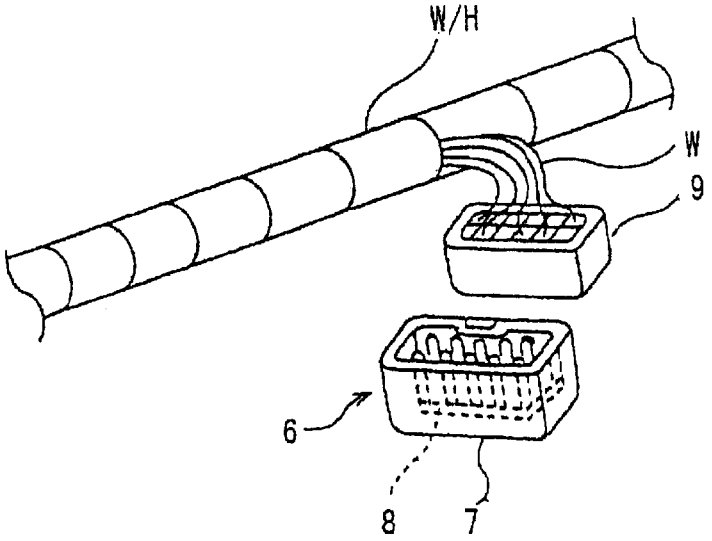
FIG.2 PRIOR ART
FIG. 2 shows a wire harness, a junction connector and a counterpart connector known in the prior art.
Figure 3A:
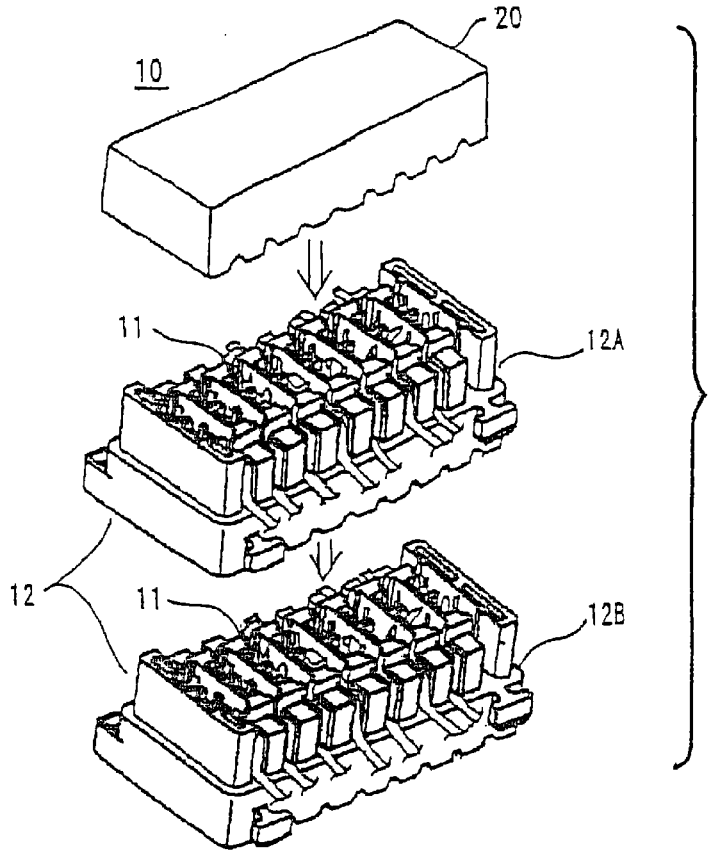
FIG. 3A is an exploded perspective view of a junction connector according to a first embodiment of the present invention, showing separate junction cases.
Figure 3B:
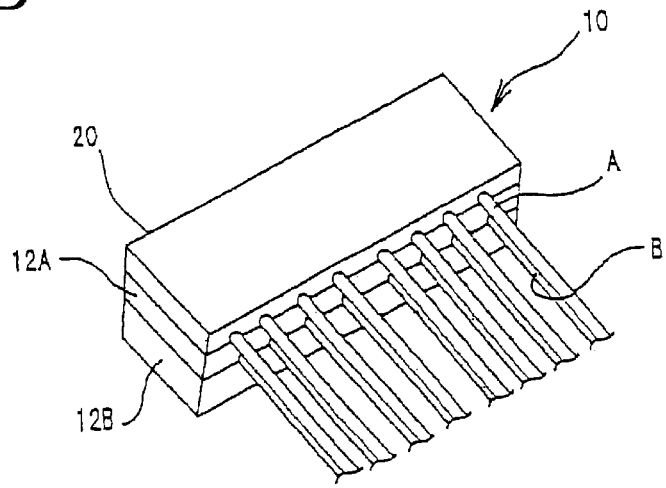
FIG. 3B is a schematic view of the junction connector of FIG. 3A, when the separate junction cases are assembled.

FIGS. 3A and 3B show a junction connector 10 according to the present invention, in which are superposed first and second junction cases 12A and 12B, respectively containing connecting terminals 11. As shown in FIG. 3B, the junction cases 12A and 12B are respectively connected to corresponding sub-harnesses A and B, which are preliminarily bundled. The first and second junction cases 12A and 12B are superposed in the final bundling process.

In the above-mentioned process, only two junction cases 12A and 12B are connected to corresponding sub-harnesses A and B and then superposed. However, the number of junction cases may be more than two, so that the number of sub-harnesses can also be increased.

Among the electrical cables included in the sub-harnesses A and B supra, those to be connected to each other are wired in a junction case 12 of junction connector 10, and press-connected preliminarily to the connector terminals 11 contained in the junction case 12.

Figure 4A:
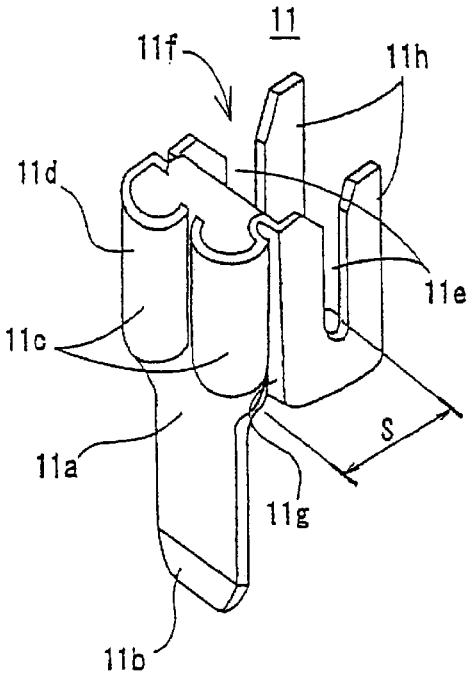
FIG. 4A is a perspective view of a connector terminal contained in a junction case of FIG. 3A.

The connector terminals 11 are formed by stamping pieces out from a conductor metal sheet and configuring them, so as to form shaped pieces such as the one shown in FIG. 4A. A shaped piece includes a strip unit 11*a* and a shoulder unit 11*g* formed on the back thereof. The strip unit 11*a* includes a substantially rectangular strip, which extends from top (shoulder unit side) to bottom ends, and has a first and second face, and a longitudinal center axis. The bottom end of the strip unit 11*a* forms a male terminal 11*b* in the shape of a tab. Both lateral rims adjacent the top end of the strip unit 11*a* are provided with a respective first wing portion. These wing portions are rounded onto the first face of rectangular strip unit 11*a*, opposing the second face where the shoulder unit is formed, towards the center axis of the strip unit 11*a*, so as to form a pair of elastic holding portions 11*c* which serve as a female terminal 11*d*.

The shoulder unit 11*g* is located on the second face of the strip unit, opposite the female terminal 11*d* and includes a cable-fit portion 11*f*. The cable-fit portion 11*f* includes two second wing portions 11*h* which extend perpendicular to the strip unit plane. The second wing portions 11*h* include press-fit notches 11*e* formed from the top end thereof. The internal circular face of the press-fit notches is provided with a press-fit blade.

In the above-mentioned manner, the male terminal 11*b* and the female terminal 11*d* are arranged on the same center axis of the strip unit. Further, an electrical cable, when fitted into the cable-fit portion 11*f*, is positioned at a distance S from the male and the female terminals 11*b* and 11*d*.

Figure 4B:
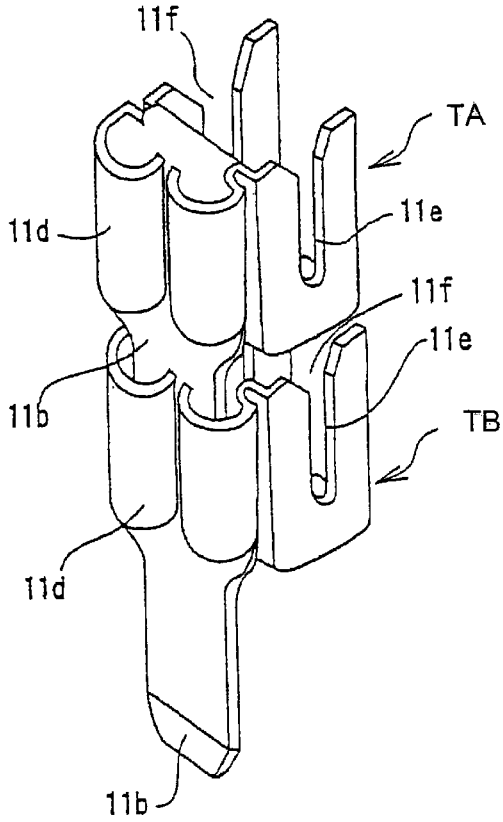
FIG. 4B is a perspective view of two connector terminals of FIG. 4A when they are superposed.
Figure 4C:
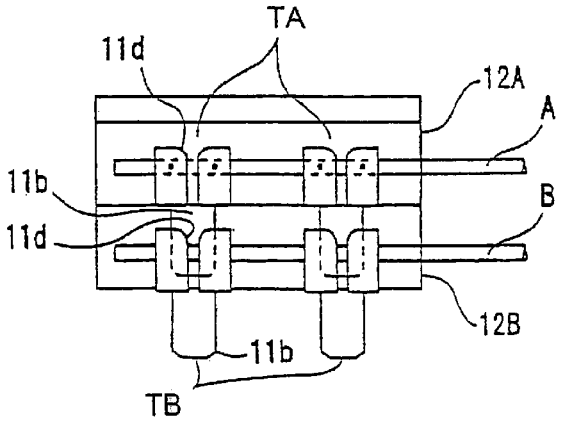
FIG. 4C is a side elevational view of two junction cases when they are superposed, such that the connector terminals of each junction case, together with the electrical cables, are connected.

As shown in FIGS. 4B and 4C, the connector terminals 11 are superposed such that the male terminals 11*b* of the upper connector terminals TA are inserted into the female terminals 11*d* of the lower connector terminals TB.

Figure 5A:
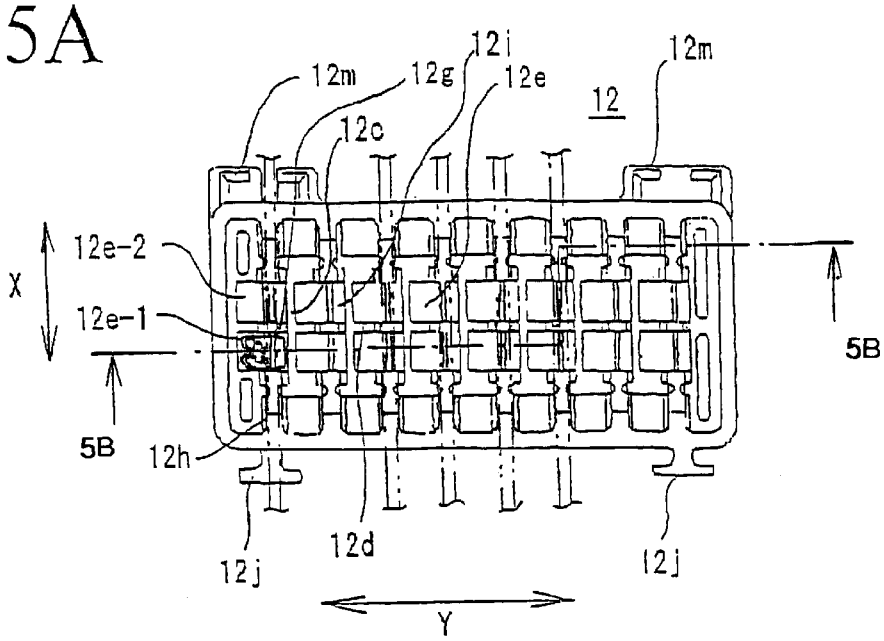
FIG. 5A is a top plan view of a junction case.
Figure 5B:
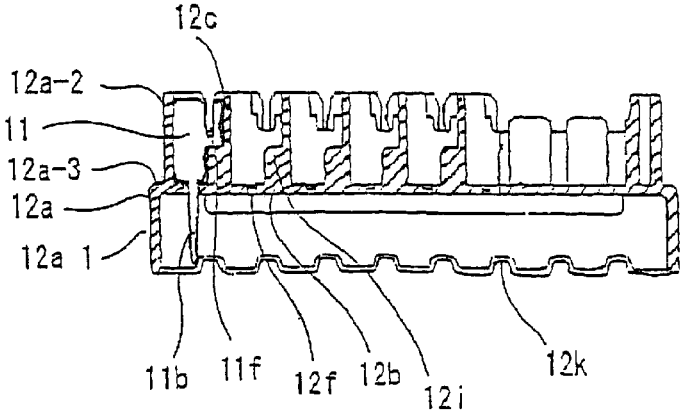
FIG. 5B is a cross-sectional view of the junction case of FIG. 5A along line 5B—5B of FIG. 5A.
Figure 5C:
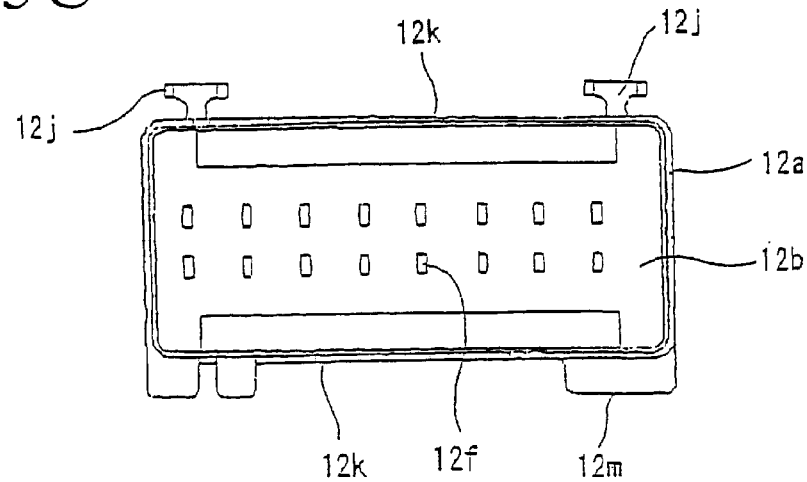
FIG. 5C is a bottom plan view of the junction case of FIG. 5A.

As shown in FIGS. 5A–5C, the junction case 12 (12A or 12B) is preliminarily mounted with the connector terminals 11. The junction case 12 is in the form of a rectangular box including a peripheral wall 12*a*, and top and bottom openings. The peripheral wall 12*a* has an upper wall unit 12*a*-2 and a lower wall unit 12*a*-1 which is larger than the former, thereby forming a wall step 12*a*-3. First cable grooves 12*h* are formed widthwise, at a given pitch, along the length direction of the upper wall unit 12*a*-2. Further, a horizontal partition wall 12*b* is formed at the level of the wall step 12*a*-3 inside the case 12. The upper side of the horizontal wall 12*b* is further provided with short partition walls 12*c* arranged widthwise of the junction case 12 (X direction), and with long partition walls 12*d* arranged lengthwise thereof (Y direction). By virtue of this configuration, the junction case 12 includes a plurality of arrays of enclosures (8 arrays in the present embodiment) aligned widthwise (X direction), each array including two terminal-enclosures 12*e* arranged along the width direction. The junction case 12 thus includes 16 terminal-enclosures 12*e*. Each terminal-enclosure 12*e* has an upper opening and a base (part of the horizontal partition wall 12*b*) with a terminal-hole 12*f*, through which the male terminal 11*b* of the connector terminal 11 is passed. The short partition walls 12*c* are further provided with a respective step-shaped carrier 12*i* for the cable-fit portion 11*f*.

In order to connect through the terminal-enclosures of each array, e.g. terminal-enclosures 12*e*-1 and 12*e*-2 of the first array, the long partition walls 12*d* are provided with a respective top end opening 12*g*. The top end openings 12*g* are then linked to the first cable grooves 12*h* in the peripheral wall 12*a*.

Figure 6:
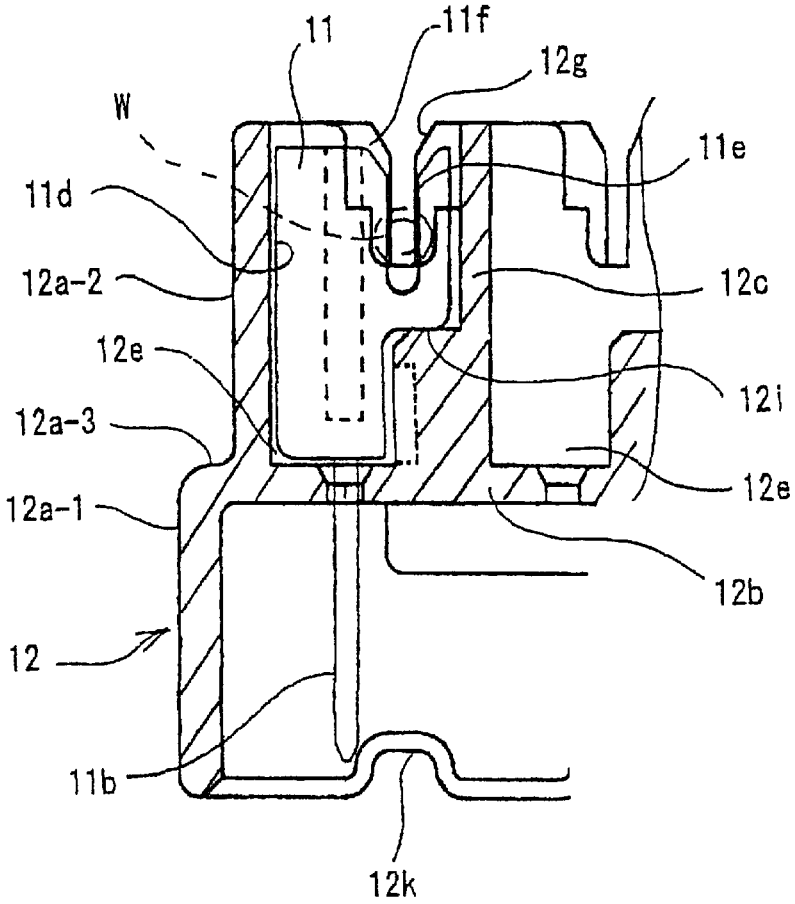
FIG. 6 is an enlarged view of a connector terminal when it is contained in a terminal enclosure of a junction case.

As shown in FIG. 6, an electrical cable passes through the two terminal-enclosures 12*e* of each array, and crosses above the cable-fit portion 11*f* of the connector terminal 11 contained in the terminal-enclosure 12*e*. In the above connector terminal, the cable-fit portion 11*f* (more specifically, press-fit notch 11*e*) is placed at the same distance from either the male terminal 11*b* or the female terminal 11*d*, so that the electrical cable can be placed in a position to be connected to the cable-fit portion 11*f* without interference from the male and female terminals 11*b* and 11*d*.

A set of cases 12 is assembled as follows. The first junction case 12A and the second junction case 12B are preliminarily connected to the sub-harnesses A and the sub-harnesses B, respectively in the primary bundling process. Then, the first junction case 12A is superposed on the second junction case 12B in the final bundling process. The lower peripheral wall portion 12*a*-1 includes a first long side-wall and a second long side-wall parallel thereto. They have a given width which includes an upper half zone and a lower half zone. These zones further include a first end portion (e.g. right-hand side in FIGS. 3A and 7) and a second end portion (e.g. left-hand side in the same figures) distal thereto. The lower half zone of the first and second long side-walls is provided with second cable grooves 12*k* from its bottom rim, at a given pitch across the both long side-walls. Further, a knob portion 12*j* is provided on the first end portion of the upper half zone of the first long side-wall, as well as on the second end portion of its lower half zone. Likewise, a counterpart bracket portion 12*m* is provided on the second long side-wall, on the sites corresponding to those of the knob portions 12*j*.

Figure 7:
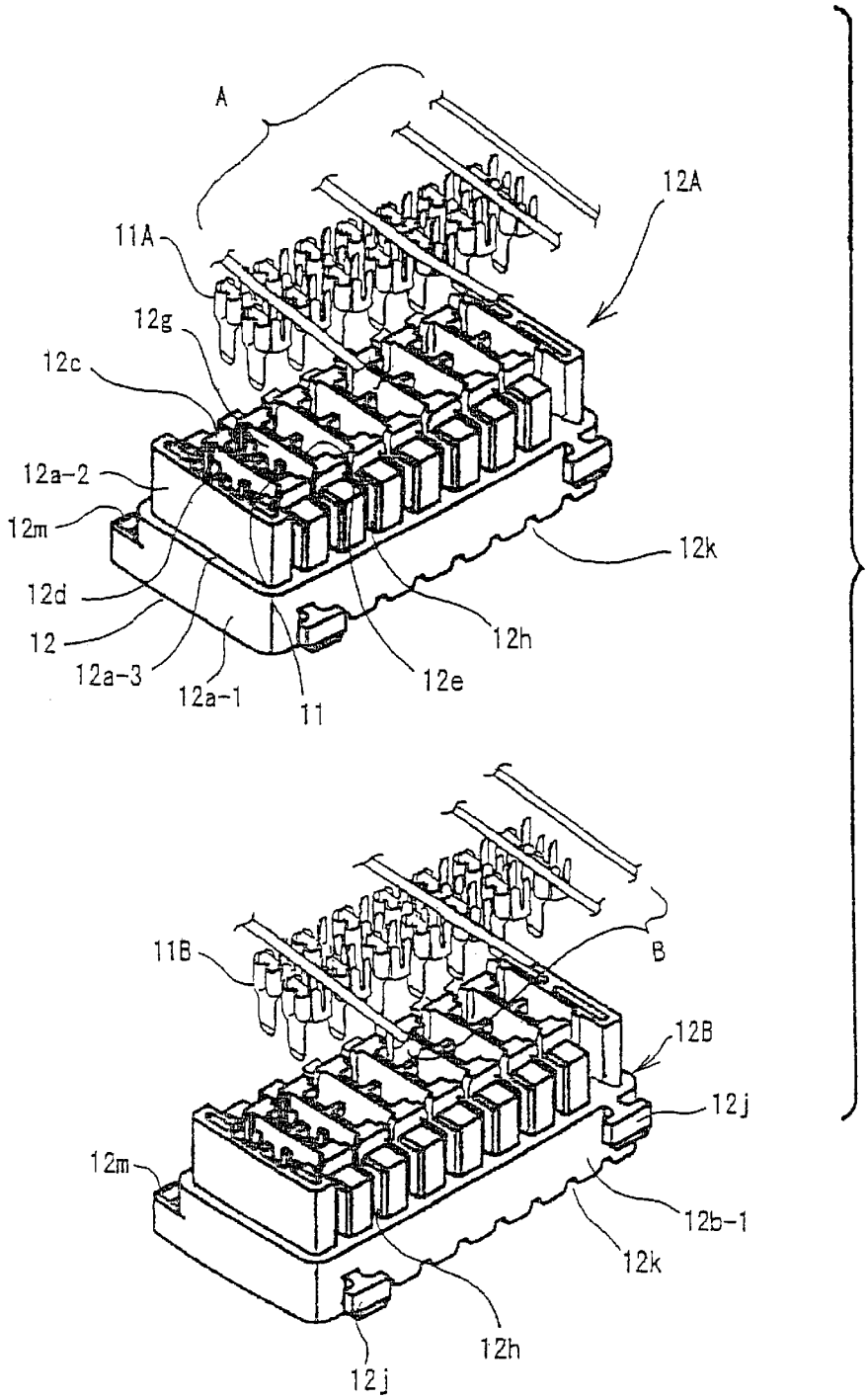
FIG. 7 is a perspective view showing how electrical cables are press-connected to connector terminals and installed in a junction case.
Figure 8A:
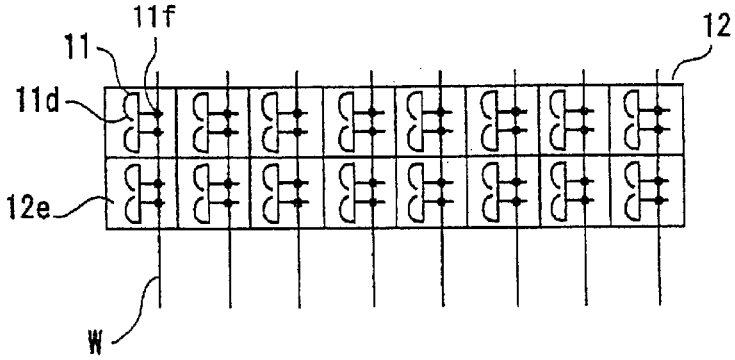
FIGS. 8A, 8B and 8C show different aspects of the connection between electrical cables and connector terminals.
Figure 8B:
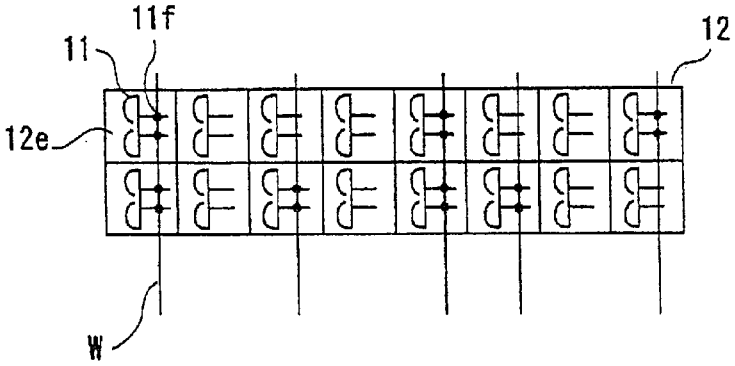
Figure 8C:
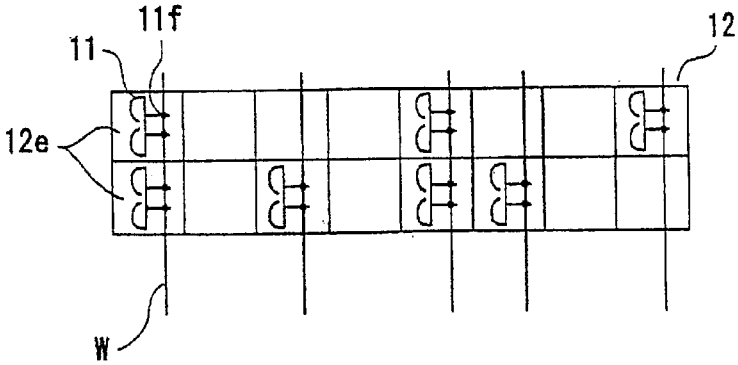

As schematically shown in FIGS. 7 and 8, the electrical cables w of the sub-harnesses A and B are wired in the junction cases 12A and 12B along the X direction thereof, so that they are passed through the terminal-enclosures 12*e* of each array. The electrical cables w are then pressed into the cable-fit portions 11*f* of the connector terminals 11 contained in the terminal-enclosures 12*e*. In this manner, the electrical cables w are press-connected with the connector terminals 11.

As shown in FIG. 3B, the junction case 12A is connected to the electrical cables of sub-harness A, whilst the junction case 12B is connected to the electrical cables of sub-harness B. The sub-harnesses A and B are manufactured separately. The junction cases 12A and 12B are superposed in the final bundling process. At this step, the lower wall unit 12*a*-1 of the first junction case 12A is fitted over the upper wall unit 12*b*-1 of the second junction case 12B. When superposing the first junction case 12A on the second case 12B, one of them is rotated horizontally by 180 degrees with respect to the other, so that the knob portion 12*j*of first junction case 12A, located in the lower half zone, is locked with the bracket portion 12*m* of second junction case 12B, located in the upper half zone. The electrical cables w passing through the second junction case 12B are then passed through the second cable grooves 12*k* of the first junction case 12A. A lid 20 may be provided to close the top of the first junction case 12A.

As shown in FIG. 3B, the junction case 12A is connected to the electrical cables of sub-harness A, whilst the junction case 12B is connected to the electrical cables of sub-harness B. The sub-harnesses A and B are manufactured separately. The junction cases 12A and 12B are superposed in the final bundling process. At this step, the lower wall unit 12*a*-1 of the first junction case 12A is fitted over the upper wall unit 12*b*-2 of the second junction case 12B. When superposing the first junction case 12A on the second case 12B, one of them is rotated horizontally by 180 degrees with respect to the other, so that the knob portion 12*j* of first junction case 12A, located in the lower half zone, is locked with the bracket portion 12*m* of second junction case 12B, located in the upper half zone. The electrical cables w passing through the second junction case 12B are then passed through the second cable grooves 12*k* of the first junction case 12A. A lid 20 may be provided to close the top of the first junction case 12A.

When the first and second junction cases 12A and 12B are joined together, the male terminals 11*b* of the connector terminals 11 contained in the first junction case 12A are passed through the terminal-holes 12*f*, and fitted into the corresponding female terminals 11*d* of the connector terminals 11 contained in the second junction case 12B. In this manner, the connector terminals 11 arranged on the same vertical axis of the first and second junction cases 12A and 12B become connected.

As a result, the chosen electrical cables in sub-harness A and those in sub-harness B can be electrically connected to each other through the corresponding connector terminals 11 in the first and second junction cases 12A and 12B. These chosen electrical cables in the sub-harnesses A and B can be preliminarily connected, at the primary bundling step, to the connector terminals 11 in the first and second junction cases 12A and 12B that form a junction connector 10. Accordingly, "hanging" terminals otherwise exposed until the final bundling step can be avoided. Therefore, the sub-harnesses already secure a finalized configuration.

Figure 9:
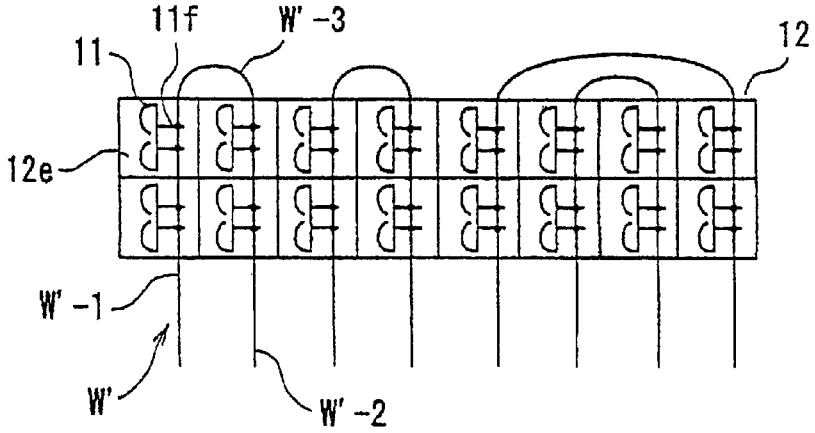
FIG. 9 shows how a looped electrical cable is connected according to a second embodiment of the invention.

FIG. 9 shows a second embodiment of the invention in which, when electrical cables w of a sub-harness are connected to connector terminals 11 in a set of junction cases, the two electrical cables w are replaced by one looped electrical cable w' having two strands w'- 1 and w'-2, and a curved portion w'-3 bridging them. The looped cable w' is passed through two adjacent arrays in the set of junction cases 12, so that the two strands w'-1 and w'-2 are connected respectively with two arrays of connector terminals 11. Thereafter, the curved portion w'-3 is cut off, forming two electrical cables. When the looped electrical cables w' are used, the number of cables leading to a junction connector 10 for connecting sub-harnesses is reduced to one half.

Further, as shown in the right-hand side of FIG. 9, distal, not adjacent, arrays may be used for chosen circuits.

Figure 10A:
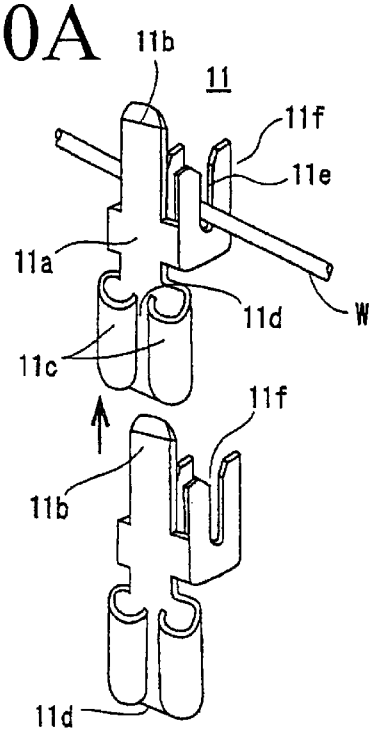
FIGS. 10A through 10D are perspective views of variants of the connector terminal.

FIGS. 10A to 10D show a connector terminal 11 according to a variant embodiment. As shown in FIG. 10A, the position of the male terminals 11*b* and that of the female terminals 11*d* of the variant connector terminals 11 are reversed with respect to the connector terminals of FIG. 4. In this embodiment, the male terminal 11*b* is formed in the shape of a tab at the top end portion of a strip unit 11*a*, whereas the female terminals 11*d* having a pair of inwardly looped elastic holding portions 11*c* is formed on the bottom end portion thereof. A cable-fit portion 11*f* is formed on a vertically middle level of the strip unit 11*a* by bending side wing portions preliminarily provided in the strip unit 11*a*.

Figure 10B:
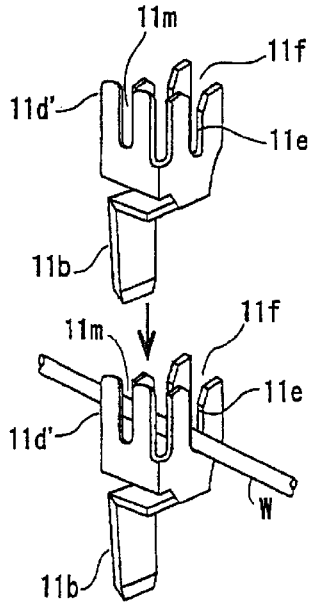

A connector terminal 11 according to FIG. 10B includes a strip unit 11 a having two wings on its upper portion. The wings have a respective groove. The bottom end of the strip unit 11*a* forms a male terminal 11*b*. The strip unit 11*a* is bent horizontally on a level just under the two wings, and then projects downwardly. The two wings are bent such as to be positioned over the horizontally bent strip unit 11*a*, and form a cable-fit portion 11*f* with press-fit notches 11*e* and a tab-receiving groove 11*m* serving as a female terminal 11*d*'. The female terminal 11*d*' is positioned such as to receive the male terminal 11*b* of an upper junction case. The female terminal 11*d*' thus has a tab-receiving groove 11*m* suitable to be press-fitted by the male terminal 11*b*. As the female terminal 11*d*' has no elastic holding portion, it can be manufactured very easily.

Figure 10C:
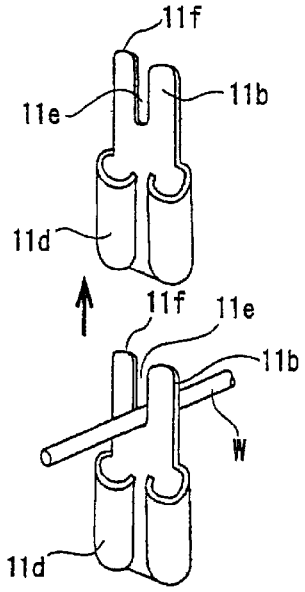

The connector terminal 11 according to FIG. 10C has a male terminal 11*b* at the top portion of the strip unit 11*a* and a female terminal 11*d* at the bottom portion thereof. The top end of the male terminal 11*b* is vertically notched on the center axis, so as to form a cable-fit portion 11*f* with a press-fit notch 11*e*. The male terminal 11*b* thus also serves as a cable-fit portion 11*f*.

Figure 10D:
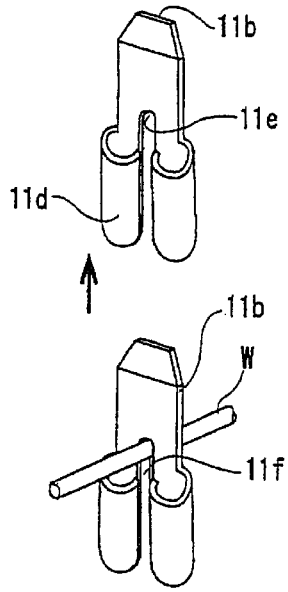

In the connector terminal 11 according to FIG. 10D, the female terminal 11*d* is vertically notched on the center axis, so as to form a cable-fit portion 11*f* with a press-fit notch 11*e*. The female terminal 11*d* thus serves also as a cable-fit portion 11*f*.

Figure 11:
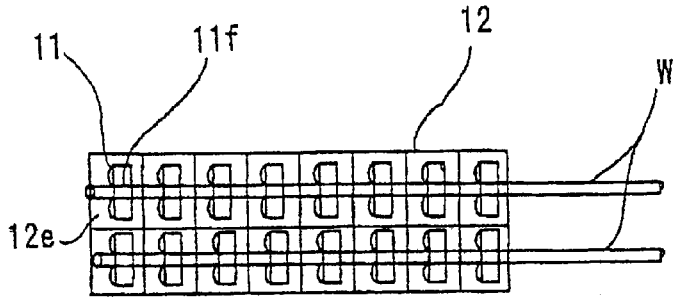
FIG. 11 is a schematic view showing how the electrical cables are connected to the connector terminals of FIGS. 10C and 10D.

In the connecting terminals shown in FIGS. 10C and 10D, either the male terminal or the female terminal is provided with a press-fit notch 11*e*. In this construction, the configuration of the connector terminal becomes very simple. In this case, however, the electrical cable w must be wired in a direction perpendicular to the arrays of the terminal-enclosures 12*e* arranged inside the junction case 12 (FIG. 11).

A connector terminal shown in FIGS. 10A to 10D is connected to an electrical cable by press-fitting, so that the connecting process can be automated easily. Further, the male terminal group and the female terminal group are provided respectively at the first end portion (e.g. top portion) and at the second end portion (e.g. bottom portion) of the connector terminals. Electrical connections can thus be made simply by superposing both groups of connector terminals, so that connections of the cables wired on an upper level and on a lower level can be made very easily. These connector terminals can be used not only in junction connectors 10 shown in FIG. 3, but also as terminals for electrical connections in varieties of devices.

According to a junction connector of the present invention, its cases contain connector terminals, each of which include a cable-fit portion, and a male terminal portion located at one of either the top side or the bottom side of the connector terminal, and a female terminal portion located at the other side thereof. The electrical cables are then press-fitted into the connector terminals. Subsequently, the junction connector cases (e.g. a first case and a second case) are superposed to each other, so that the connector terminals are linked by the coupling of the male terminal portions of a first junction case and the female terminal portions of a second junction case. The electrical cables fitted into the first junction case can thus be connected to the electrical cables fitted into the second junction case.

In the past, some electrical cables in a sub-harness were connected by inserting terminals a posteriori, or by splice-connecting the cables to each other. These electrical cables can now be preliminarily connected to the connector terminals contained in the junction cases. These junction cases are then superposed and integrated to a junction connector in the final bundling process, so that the electrical cables in each sub-harness are connected to one another. As a result, later insertion of terminals into sub-harnesses can be avoided, and splice-connections of electrical cables can be obviated. As a whole, the efficiency of assembling the wire harness assembly is greatly improved.

As the connector terminals are preliminarily contained in the junction cases, circuits can be modified easily simply by changing press-fit positions between connector terminals and electrical cables. Therefore, changes of circuit configurations, e.g. to accommodate a different automobile type or grade, can be made very easily. Moreover, the junction cases containing the connector terminals have a wide use.

As a variant, sub-harness electrical cables connecting to the connector terminals in the junction cases may be in a looped shape forming two strands and a curved portion. The two strands are then connected to two arrays of connecting terminals, respectively, and the curved portion is cut off. In this manner, the number of electrical cables used for connecting to the junction connector can be reduced to one half.

Although the invention has been described with reference to particular means, materials and embodiments, it is to be understood that the invention is not limited to the particulars disclosed and extends to all equivalents within the scope of the claims.

The present disclosure relates to subject matter contained in priority Japanese Application No. HEI 11-212838, filed on Jul. 27, 1999.

What is claimed:

1. A connector terminal formed of an electrically conductive metallic material, said connector terminal comprising a strip unit having a first end portion, a second end portion and a longitudinal center axis, said connector terminal further comprising a cable-fit portion with a cable-fit element formed by bending a part of said strip unit, said strip unit including a planar male terminal portion located at said first end portion and a female terminal portion located at said second end portion, a part of said female terminal portion and said planar male terminal portion defining a plane, said male and female terminal portions being positioned on said longitudinal center axis, said cable-fit element being spaced apart from said planar male terminal portion and said female terminal portion, and said cable-fit element configured to receive a cable inserted in a direction generally parallel to said longitudinal center axis and with a longitudinal axis of the cable generally parallel to the plane of said planar male terminal portion.

2. The connector terminal according to claim 1, wherein said female terminal portion comprises a pair of looped ribbons formed by looping side wing portions of said strip unit towards said longitudinal center axis, said looped ribbons configured to elastically hold said planar male terminal portion.

3. The connector terminal according to claim 1, wherein said female terminal portion comprises a notch formed along said longitudinal center axis and configured to receive said planar male terminal portion.

4. The connector terminal according to claim 1, wherein the cable-fit element is spaced apart from said longitudinal center axis.

5. A junction connector comprising at least a first junction case and a second junction case superposed thereon, each of said first and second junction cases having a top opening and a bottom opening and containing at least one connector terminal formed of an electrically conductive metallic material and configured to connect to electrical cables;

each of said connector terminals comprising a strip unit having a first end portion, a second end portion and a longitudinal center axis, said connector terminals further comprising a cable-fit portion with a cable-fit element formed by bending a part of said strip unit, said strip unit including a planar male terminal portion located at said first end portion and a female terminal portion located at said second end portion, a part of said female terminal portion and said planar male terminal portion defining a plane, said male and female terminal portions being positioned on said longitudinal center axis, said cable-fit element being spaced apart from said planar male terminal portion and said female terminal portion, and said cable-fit element configured to receive a cable inserted in a direction generally parallel to said longitudinal center axis and with a longitudinal axis of the cable generally parallel to the plane of said planar male terminal portion;

wherein said first junction case is superposed on said second junction case such that said planar male terminal portions contained in said first junction case fit into said female terminal portions contained in said second junction case and are connected thereto through respective ones of said top and bottom openings.

6. The junction connector according to claim 5, wherein said first and second junction cases comprise arrays of connector terminals aligned at a given pitch, each array including a plurality of connector terminals which are configured to fit with a corresponding electrical cable wired along said array.

7. The connector terminal according to claim 5, wherein the cable-fit element is spaced apart from said longitudinal center axis.

8. A junction connector comprising at least a first junction case and a second junction case superposed thereon, each of said first and second junction cases having a top opening and a bottom opening and containing at least one connector terminal formed of an electrically conductive metallic material configured to connect to electrical cables;

each of said connector terminals comprising a strip unit having a first end portion, a second end portion and a longitudinal center axis, said connector terminal further comprising a cable-fit portion with a cable-fit element formed by bending a part of said strip unit, said strip unit including a planar male terminal portion located at said first end portion and a female terminal portion located at said second end portion, a part of said female terminal portion and said planar male terminal portion defining a plane, said male and female terminal portions being positioned on said longitudinal center axis, said cable-fit element being spaced apart from said planar male terminal portion and said female terminal portion, and said cable-fit element configured to receive a cable inserted in a direction generally parallel to said longitudinal center axis and with a longitudinal axis of the cable generally parallel to the plane of said planar male terminal portion;

said female terminal portion comprising a pair of looped ribbons formed by looping side wing portions of said strip unit toward said longitudinal center axis, said looped ribbons configured to elastically hold said planar male terminal portion;

wherein said first junction case is superposed on said second junction case such that said planar male terminal portions contained in said first junction case fit into said female terminal portions contained in said second junction case and are connected thereto through respective ones of said top and bottom openings.

9. The junction connector according to claim 8, wherein said first and second junction cases comprise arrays of connector terminals aligned at a given pitch, each array including a plurality of connector terminals which are configured to fit with a corresponding electrical cable wired along said array.

10. The connector terminal according to claim 8, wherein the cable-fit element is spaced apart from said longitudinal center axis.

11. A junction connector comprising at least a first junction case and a second junction case superposed thereon, each of said first and second junction cases having a top opening and a bottom opening and containing at least one connector terminal formed of an electrically conductive metallic material configured to connect to electrical cables;

each of said connector terminals comprising a strip unit having a first end portion, a second end portion and a longitudinal center axis, said connector terminal further comprising a cable-fit portion with a cable-fit element formed by bending a part of said strip unit, said strip unit including a planar male terminal portion located at said first end portion and a female terminal portion located at said second end portion, a part of said female terminal portion and said planar male terminal portion defining a plane, said male and female terminal portions being positioned on said longitudinal center axis, said cable-fit element being spaced apart from said planar male terminal portion and said female terminal portion, and said cable-fit element configured to receive a cable inserted in a direction generally parallel to said longitudinal center axis and with a longitudinal axis of the cable generally parallel to the plane of said planar male terminal portion;

said female terminal portion comprising a notch formed along said longitudinal center axis and adapted for receiving said planar male terminal portion;

wherein said first junction case is superposed on said second junction case such that said planar male terminal portions contained in said first junction case fit into said female terminal portions contained in said second junction case and are connected thereto through respective ones of said top and bottom openings.

12. The junction connector according to claim 11, wherein said first and second junction cases comprise arrays of connector terminals aligned at a given pitch, each array including a plurality of connector terminals which are configured to fit with a corresponding electrical cable wired along said array.

13. The connector terminal according to claim 11, wherein the cable-fit element is spaced apart from said longitudinal center axis.

14. A wire harness including a junction connector comprising at least a first junction case and a second junction case superposed thereon, each of said first and second junction cases having a top opening and a bottom opening and containing at least one connector terminal formed of an electrically conductive metallic material configured to connect to electrical cables;

each of said connector terminals comprising a strip unit having a first end portion, a second end portion and a longitudinal center axis, said connector terminal further comprising a cable-fit portion with a cable-fit element formed by bending a part of said strip unit, said strip unit including a planar male terminal portion located at said first end portion and a female terminal portion located at said second end portion, a part of said female terminal portion and said planar male terminal portion defining a plane, said male and female terminal portions being positioned on said longitudinal center axis, said cable-fit element being spaced apart from said planar male terminal portion and said female terminal portion, and said cable-fit element configured to receive a cable inserted in a direction generally parallel to said longitudinal center axis and with a longitudinal axis of the cable generally parallel to the plane of said planar male terminal portion;

said first junction case being superposed on said second junction case such that said planar male terminal portions contained in said first junction case fit into said female terminal portions contained in said second junction case and are connected thereto through said top and bottom openings;

said wire harness comprising different sub-harnesses connected to one another through said connector terminals, any one of said sub-harnesses comprising a group of electrical cables connected to said connector terminals contained in said junction cases, each sub-harness being connected to one of said junction cases, and said sub-harnesses being assembled by said superposing of said junction cases.

15. A wire harness according to claim 14, wherein said first and second junction cases comprise arrays of connector terminals aligned at a given pitch, each array including a plurality of connector terminals which are fitted with a corresponding electrical cable wired along said array.

16. The connector terminal according to claim 14, wherein the cable-fit element is spaced apart from said longitudinal center axis.

* * * * *

UNITED STATES PATENT AND TRADEMARK OFFICE

CERTIFICATE OF CORRECTION

PATENT NO. : 6,533,604 B2
DATED : March 18, 2003
INVENTOR(S) : N. Kobayashi et al.

It is certified that error appears in the above-identified patent and that said Letters Patent is hereby corrected as shown below:

Title page,
Item [56], References Cited, U.S. PATENT DOCUMENTS, include:

| | | |
|---|---|---|
| -- 5,362,242 | 11/08/94 | Nakamura |
| 5,605,465 | 02/25/97 | Kobayashi et al. |
| 5,934,929 | 08/10/99 | Saka et al. -- |

U.S. PATENT DOCUMENTS, include:

| | | |
|---|---|---|
| -- 9-50835 | 02/18/97 | Japan |
| 736929 | 10/09/96 | EPO -- |

Signed and Sealed this

Thirteenth Day of January, 2004

JON W. DUDAS
*Acting Director of the United States Patent and Trademark Office*